United States Patent [19]

Kristanek et al.

[11] Patent Number: 4,609,793

[45] Date of Patent: Sep. 2, 1986

[54] ELECTRICAL SLIDE SWITCHING DEVICE

[75] Inventors: Henri Kristanek; Pierre Dégrange, both of Annecy, France

[73] Assignee: ITT Industries, Inc., New York, N.Y.

[21] Appl. No.: 679,803

[22] Filed: Dec. 10, 1984

[30] Foreign Application Priority Data

Dec. 13, 1983 [FR] France ..... 83 19931

[51] Int. Cl.[4] ..... H01H 15/00

[52] U.S. Cl. ..... 200/16 D

[58] Field of Search ..... 200/5 A, 11 K, 11 G, 200/11 TW, 16 C, 16 D, 275, 292

[56] References Cited

U.S. PATENT DOCUMENTS

| | | | |
|---|---|---|---|
| 2,863,966 | 12/1958 | Greber | 337/228 |
| 3,350,673 | 10/1967 | Spaude | 200/11 K X |
| 3,689,714 | 9/1972 | Walz | 200/16 D X |
| 3,745,270 | 7/1973 | Grunitz | 200/5 A X |
| 3,800,107 | 3/1974 | Heide | 200/16 D |
| 3,808,384 | 4/1974 | Boulanger | 200/5 A |
| 3,857,000 | 12/1974 | Boulanger | 200/16 D |
| 3,896,276 | 7/1975 | Held | 200/16 D X |
| 4,072,833 | 2/1978 | Carena | 200/16 D |

*Primary Examiner*—J. R. Scott

*Attorney, Agent, or Firm*—James B. Raden; William J. Michals

[57] ABSTRACT

An electrical switching device for a low cost measuring apparatus. The device comprises fixed contact elements which are made as straps implanted in a printed circuit board and a movable contact element made as a flexible blade mounted on a carrier device arranged on a slide attached to the PC board. The straps may be positioned by an automatic component insertion machine.

2 Claims, 6 Drawing Figures

ELECTRICAL SLIDE SWITCHING DEVICE

BACKGROUND OF THE INVENTION

This invention relates to an electrical switching device and, more particularly, to a device of the type consisting mainly of a fixed contact element and a movable contact element together with means for controlling the position of the movable contact element such that the latter is controllably positioned against the fixed contact element, thus establishing an electrical circuit.

The main object of the invention is to produce a particularly inexpensive switching device. It is directed towards a switching device intended for use in connection with circuits on a printed circuit board.

SUMMARY OF THE INVENTION

According to one essential feature of the invention, the fixed contact element is given the form of an elongated conductive part, bent into the general shape of a "U" and inserted into a printed circuit board in such a way as to be in electrical contact with a conducting track on this board.

This part, which could be a piece of wire, strip or profiled section, is secured to the printed circuit board by being soldered to at least one pad associated with a printed circuit track, this provides the mechanical holding and electrical connection at the same time. In practice, this fixed contact is fitted and soldered in the same way as the other components for the board. In a particularly inexpensive implementation, the element is inserted by an automatic insertion machine and wave soldered in the same manner as the other components.

This fixed contact element will be made at least partially, of a conductive metal such as copper or a copper alloy. This metal must also be soldered. It could, if necessary, be coated, at least partially, with a precious metal, for example, silvered, to improve its contact characteristics.

According to another essential feature of the invention, the switching device consists of at least two fixed contact elements, such as previously described, and the moving contact element is arranged to bear simultaneously on the two fixed contact elements.

In particular, the moving contact element is a flexible blade, mounted on a carrier device arranged so as to bring the movable contact element on to the two fixed contact elements. Preferably, the carrier device will allow the flexible blade to be moved perpendicularly to its length.

According to one embodiment of the invention, both fixed contact elements will be positioned side by side, parallel to the length of the said flexible blade. The spacing of the two fixed contacts and the width of the flexible blade will be such that the blade is able to bear at its end on both fixed contacts at the same time. In such a case, a longitudinal slot will be provided in the flexible blade, so as to split it into two strips bearing independently on both fixed contact elements.

The two fixed contact elements could also be arranged, one in line with the other, the length of the blade being such that it is able to bear on both.

According to another implementation, two pairs of fixed, side by side, contact elements are arranged in line with one another and said movable contact element is a cylindrical element containing a fuse wire which is arranged to come into contact with both of the elements of each pair at each end of the cylindrical element.

It is also possible to position one fixed contact element parallel to the motion of the blade and at least another one perpendicularly, the flexible blade bearing on each of them at its two ends.

In a practical realization, the carrier device consists of a cursor arranged on a slide. A flexible blade or movable contact is mounted to the carrier device. Stop arrangements will define the precise rest positions of the cursor in relation to which the fixed contact elements will be arranged.

These stop arrangements may take the form of a rack, integral with the slide, in conjunction with a spring loaded ball carried by the cursor.

The slide will preferably be a moulded part added to the printed circuit board, which will carry tracks which are terminated by perforations which are arranged to receive the fixed contact elements that are inserted in the printed circuit board through the slide, so that they mechanically secure the slide to the board.

BRIEF DESCRIPTION OF THE DRAWING

The various objects and features of the invention will now be detailed in the description that follows, given as a non-limiting example with reference to the drawing in which.

DETAILED DESCRIPTION

Figure 1:
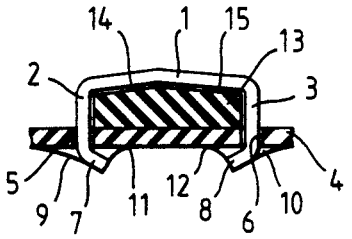
FIG. 1 illustrates the general form of a fixed contact element designed in accordance with this invention.

FIG. 1 represents a fixed contact element designed in conformance with the invention. The fixed contact element 1 is a piece of copper wire bent to have the general shape of a "U" and having two legs 2 and 3 which to pass through the printed circuit board 4, using the pierced holes 5 and 6 in this board 4, and whose ends 7 and 8 are inwardly folded and held in the solder blocks 9, 10 joined to the solder pads 11, 12. The fixed contact element is mechanically secured to the board 4 in this way. It is electrically connected to a printed circuit track such as pad 11, for example.

Board 4 is seen in cross section in the plane of the element 1 and a holding element 13 which is likewise shown in cross section in this plane, and can also be seen in this figure. The surface of this holding element away from the board, has the shape of an open angle with slightly inclined ramps 14 and 15. The contact element follows a similar shape for a reason to be explained later.

In practice, such a fixed contact element can be easily produced using an automatic component insertion machine with appropriated adjustments and fed with a wire of the appropriate diameter. The machine cuts a piece, bends it into a "U", presses it against the support element 13 and folds the ends 7 and 8. Thus it is no more than a strap, a component that the machine is designed to position like the other components and which will be later soldered with them in a wave soldering machine.

Figure 2:
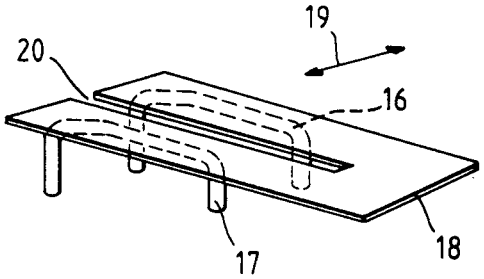
FIG. 2 illustrates a switching device arrangement with two, side by side, fixed contact elements.
Figure 3:
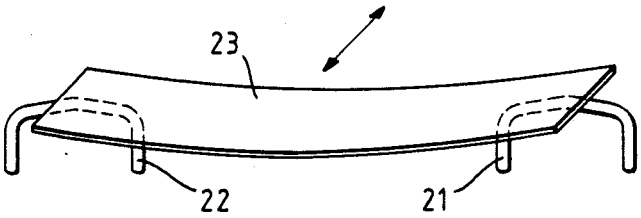
FIG. 3 illustrates a switching device arrangement with two, in line, fixed contact elements.
Figure 4:
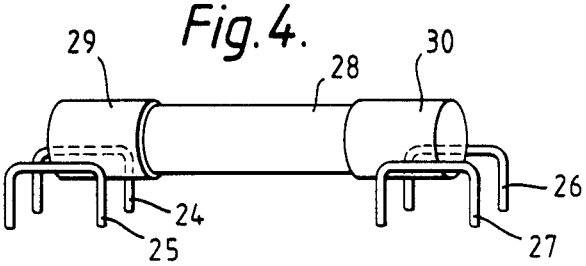
FIG. 4 illustrates an alternative device in which the movable contact element is a cylindrical fuse.

FIGS. 2, 3 and 4 show, among others, several modes of construction of a switching device conforming to the invention. In the example of FIG. 2, two fixed contact elements 16 and 17, similar to the one of FIG. 1, are positioned side by side. A moving contact element 18, in the form of an elastic conducting metal blade, can be moved in both directions, as indicated by the arrow 19, i.e., transversely, and thus can come into contact with the fixed contact elements 16 and 17. To facilitate this, the blade is provided with a slot 20 cut from the edge of the end facing the fixed contacts and running along their entire length, as to divide the blade into two strips which bear on the fixed contact elements 16 and 17, respectively, in a way that they are relatively independent from one another.

In the example of FIG. 3, the fixed contact elements 21 and 22 are arranged in line with each other and the movable contact element 23, which is likewise transversely movable, makes contact with the elements by its two ends.

In order for the flexible blade to bear on the fixed contact elements in both cases, a downward vertical pressure is applied to it by means not shown and, as can be seen from the slightly exaggerated drawings, the blade bends. In order that the blade should make the best contact with the fixed contact elements, these latter have a ramp (15 in FIG. 1) and are almost parallel to the moving contact blade for some length in the contact area.

FIG. 4 illustrates another embodiment of the invention in which two pairs of side by side, fixed contact elements (24, 25; 26, 27) are arranged in line with each other. The movable contact element 28 is a cylindrical element containing a fuse wire, whose two ends 29 and 30 each rest on a pair of fixed contact elements. A fused circuit breaker can be included in this manner. The fuse is held against its supports with sufficient pressure by means which need not be illustrated herein.

Figure 5:
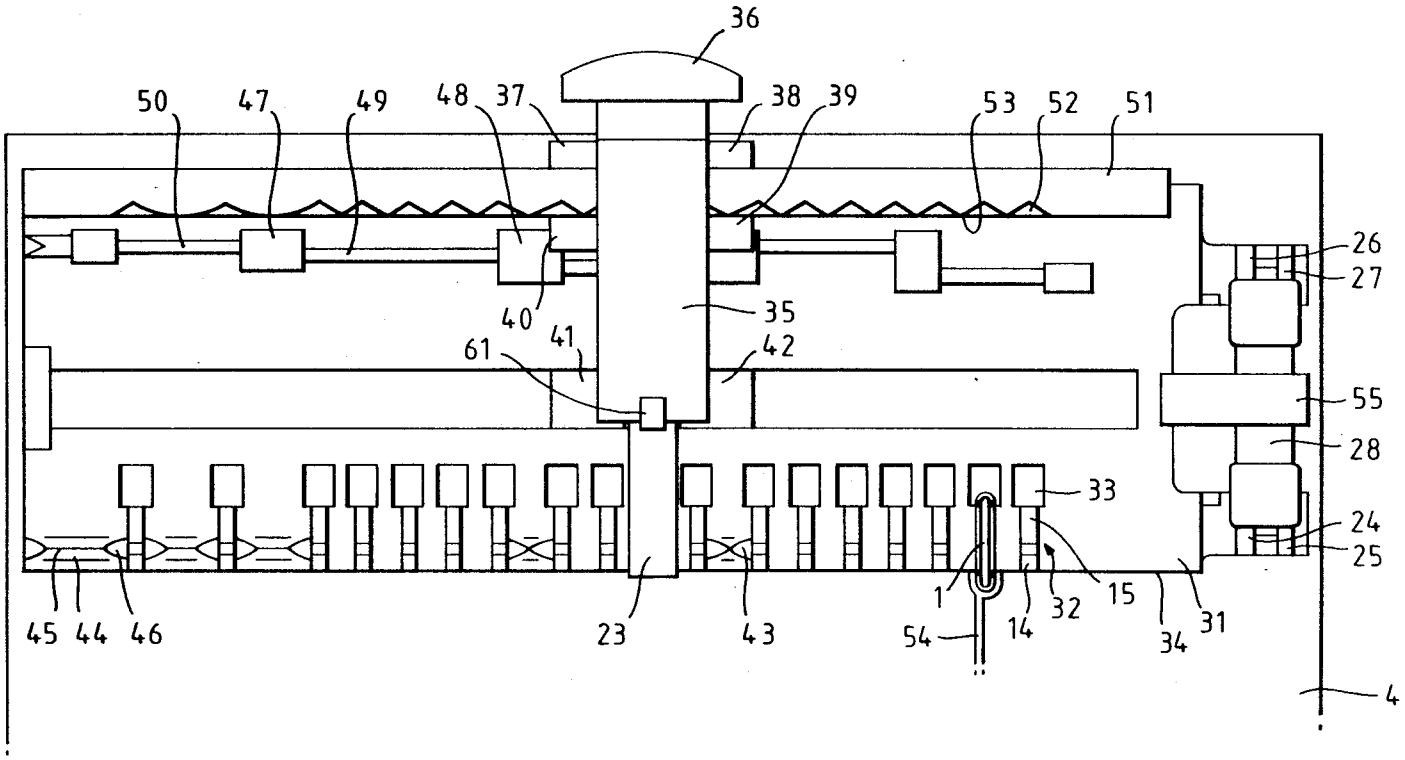
FIG. 5 illustrates a combined schematic and plan view of a switching device designed in accordance with the invention; and, FIG. 6 is a cross section view of the switching device of FIG. 5.

FIG. 5 provides an illustrative example of an embodiment of the switching device of this invention in which can be found, the fixed contact element of FIG. 1, the moving contact element of FIGS. 2 and 3 and also the alternative of FIG. 4. A moulded part 31 serving as a slide and incorporating a rack is arranged on a printed circuit board 4. This part includes positioning pins, not shown, on its side facing board 4, which correspond with bores in the board, in order to achieve precise mutual positioning. Other pins may likewise be used to clamp the two parts together. The part 31 has, along the length of its lower edge (in FIG. 5), a series of locations for fixed contact elements, only one of these being shown in 1. Looking at the neighboring location 32, it can be seen that this comprises an opening 33 through part 31. Between this opening 33 and the lower edge 34, a moulded recess forms the ramps 14 and 15 of FIG. 1 at the bottom of a shallow groove, such that the fixed contact element 1 protrudes with respect to the main surface of part 31. A cursor 35, with an operating button 36, carries a flexible blade 23. It moves transversely, sliding on guide surfaces through the guide wings 37, 38, 39, 40, 41, 42.

In this example, which corresponds to that of FIG. 3, the flexible blade 23, used as the moving contact element, is arranged to contact with only one of the fixed cntact elements at a time. Its width and the spacing of the elements have been chosen accordingly. Nevertheless, in most cases, the blade 23 is wide enough to remain supported by one fixed contact element when it reaches the following fixed contact element. When this is not required, part 31 has a boss 43, 44 between the wider spaced elements, which lifts the blade 23 by its ridge 45 and then lets it return to the contact level by its flank 46.

The other end of the blade 23, under the main part of the cursor 35 is not visible. It is designed to bear upon other fixed contact element, but unlike FIG. 3, these are not arranged in line with those of the lower edge (which would nevertheless be possible, even though costly) but perpendicular to them, that is, parallel to the motion of the cursor. There are in fact other openings 47, 48 in part 31 between which a narrow, flat bottomed shallow groove 49, 50 is worked to receive a fixed contact element of the type shown in FIG. 4. It will be noted that the elements situated in the grooves 49, 50 are arranged along several lines to avoid localized wearing of the blade 23.

The various stop positions that the cursor 35 may take are set by a rack 51 which has recesses 52 and projections 53. A spring device such as a spring loaded ball, is provided in the body of the cursor to bear upon the rack 51.

Each fixed contact element, such as that shown at 1, being soldered through part 31 to board 4 and being in electrical contact with a conducting track 54, and movement of the cursor carrying the blade 23 puts the circuit associated with one of the lower contact elements, like the one in 1, in selective electrical contact with one associated with an upper contact element, like the one which could be inserted in 49.

In addition, still in relation to FIG. 5, a fuse 28 (see FIG. 4) may be identified on the extreme right, carried by the fixed contact elements inserted in 24, 25, 26, 27. This fuse is held in position and pressed against the contacts by a moulded flexible lug 55.

Figure 6:
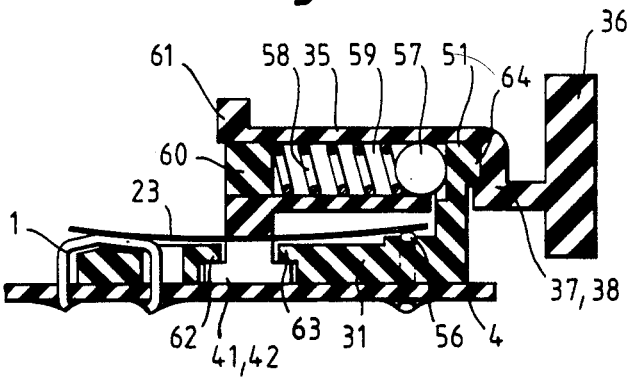

FIG. 6 is a partial section on the main axis of cursor 35. Here can be identified board 4, part 31, a fixed contact element 1 and a fixed contact element 56, at right angle to the preceding one. Blade 23, simply slided between the wings 41 and 42 (FIG. 5), may be retained longitudinally be any means.

Rack 51 can also be seen, against which ball 57 is pushed by a spring 58 housed in a recess 59 closed by a plug 60. A raised peg 61 (see also FIG. 5) can be used as a visual indication of the cursor position.

Wings 37, 38, and 41, 42 mate with the raised sections 62, 63, 64, to retain and guide the cursor on part 31 which acts as a slide for it and the rack 51 as they are at right angles to the board 4 they contribute to the rigidity of the assembly.

It should be appreciated tht the preceding descriptions are only provided as examples and that numerous variants could be envisaged without departing from the invention.

We claim:

1. An electrical switching device comprising, in combination:

a printed circuit board having a longitudinally extending slide rack thereon;

a plurality of generally U-shaped fixed contacts mounted to said printed circuit board perpendicularly of said slide rack and on one side thereof;

a carrier device slidably mounted in said slide rack for longitudinal movement therein, said carrier slide having an operating button extending perpendicularly away from said slide rack on the other side thereof;

a flexible movable contact mounted on said carrier device for engaging selected ones of said fixed contacts in response to the longitudinal movement of said carrier device;

a plurality of secondary contacts fixedly mounted to said printed circuit board perpendicularly of said slide rack on said other side thereof, said secondary contacts respectively engaging said movable contact when said movable contact engages a selected one of said fixed contacts;

a longitudinally extending stop position rack mounted parallel to and spaced apart from said slide rack on said other side thereof, said position rack having a plurality of recesses along its longitudinal direction respectively corresponding to said selected ones of said fixed contacts; and, a detent member mounted on said carrier device and being resiliently urged toward and engaging said recesses along said stop position rack.

2. The device according to claim 1, wherein said fixed contacts include ramp surfaces defined by the base of said U-shaped fixed contacts between the leg portions thereof for engaging said flexible movable contact when said movable contact is respectively, resiliently urged into engagement with said fixed contact.

* * * * *